US005526009A

United States Patent [19]

Mileski

[11] Patent Number: 5,526,009

[45] Date of Patent: Jun. 11, 1996

[54] DUAL FREQUENCY LIGHTWEIGHT DEPLOYABLE ANTENNA SYSTEM

[75] Inventor: Paul M. Mileski, Mystic, Conn.

[73] Assignee: The United States of America as represented by the Secretary of the Navy, Washington, D.C.

[21] Appl. No.: 443,919

[22] Filed: May 22, 1995

[51] Int. Cl.[6] ..... H01Q 21/26

[52] U.S. Cl. ..... 343/797; 343/709

[58] Field of Search ..... 343/890, 797, 343/709, 915; H01Q 21/24, 21/26

[56] References Cited

U.S. PATENT DOCUMENTS

| | | | |
|---|---|---|---|
| 3,702,479 | 11/1972 | Uheig | 343/797 X |
| 3,740,754 | 6/1973 | Epis | 343/797 |
| 3,922,683 | 11/1975 | Kumpebeck | 343/797 |
| 4,083,051 | 4/1978 | Woodward | 343/797 |
| 4,218,685 | 8/1980 | Ellis | 343/797 X |
| 4,446,465 | 5/1984 | Donovan | 343/797 |
| 5,091,732 | 2/1992 | Mileski et al. | 343/797 |

*Primary Examiner*—Donald T. Hajec
*Assistant Examiner*—Tho Phan
*Attorney, Agent, or Firm*—Michael J. McGowan; Prithvi C. Lall; Michael F. Oglo

[57] ABSTRACT

A lightweight deployable antenna system capable of operating at two frequencies concurrently, includes a canister providing an elongated chamber and mast therewithin. A conductor extends into the mast to provide radio signals to an antenna assembly and three broadband coaxial cables, which are coiled about a spacer and are electrically connected to the antenna assembly. The antenna assembly comprises four antenna elements of resiliently deflectable wire spaced at 90 degree intervals. Each antenna element has a generally helical coil and an elongate arm with a copper tape flag disposed on the distal end thereof. Pairs of the elongate arms form dipoles which are of differing lengths so that each pair of antenna elements resonates at a frequency which differs from the frequency at which the other pair resonates. Each elongate arm is adapted to extend downwardly in the canister in a non-deployable position and at a 45° angle to a horizontal plane in a deployed position.

10 Claims, 5 Drawing Sheets

DUAL FREQUENCY LIGHTWEIGHT DEPLOYABLE ANTENNA SYSTEM

STATEMENT OF GOVERNMENT INTEREST

The invention described herein may be manufactured and used by or for the Government of the United State of America for governmental purposes without the payment of royalties thereon or therefor.

BACKGROUND OF THE INVENTION (1) Field of the Invention

This invention relates to a lightweight deployable antenna system having the capability of operating at two frequencies.

(2) Description of the Prior Art

Deployable antenna systems are conventionally used in a variety of settings and are especially favorable for marine applications in transmitting signals to other communication systems on installations or vessels. Many of such communication systems require that the antenna be able to transmit at one frequency and receive on another frequency, or that two different antennas be deployed. However, because of volume and weight complexity considerations, deployable antennas are structurally limited, thus leading to difficulties in achieving such functioning capabilities.

Most deployable antenna systems possess the ability to transmit and receive at only one frequency. An example of such a system is found in my U.S. Pat. No. 5,091,732. Other systems permit the antenna to be adjusted so as to have the capability of operating at more than one frequency, such as the system disclosed in U.S. Pat. No. 3,557,148. However, a problem inherent in such a system is that only a single frequency may be employed at a time. Additionally, such a system is intended to be used only for low frequency range applications and cannot accommodate higher frequency ranges which many communication systems call for. A collapsible antenna system is disclosed in U.S. Pat. No. 2,673,295. However, this system operates on a single frequency and is not intended for remote or automatic deployment.

Attempts have been made to reduce the volume of components in non-deployable antenna systems, such as the antenna systems of U.S. Pat. Nos. 4,031,539, 4,446,465, and 4,686,536. However, these systems employ fixed antenna arms which are not capable of being adjusted through a range of angles.

Other antenna systems of the non-deployable type employ different frequencies for transmitting and receiving electromagnetic radiation, such as the antenna system described in U.S. Pat. No. 3,702,479. However, this system also employs fixed elements which are not capable of being adjustably moved or deployed. Moreover, the operating frequencies for such a system are lower than those usually required for marine applications.

There is thus a need for a lightweight deployable antenna system which has the capability of operating at at least two frequencies.

SUMMARY OF THE INVENTION

It is, therefor, an object of the present invention to improve the operating capabilities of a deployable antenna system while enhancing the volume and weight characteristics thereof.

A further object of the present invention is to provide a deployable antenna system operable at two frequencies concurrently.

A still further object of the invention is to provide an antenna system in which the signal bandwidth is increased at each of the operating frequencies.

A still further object of the invention is to provide an antenna system of reduced size wherein one of two operating frequencies is much lower than the other.

These and other objects are attained by providing an antenna system having a canister providing an elongated chamber and an elongated hollow mast extending therewithin, a spacer at the upper end of the canister, and a conductor extending into the hollow mast. Four antenna members of resiliently deflectable wire are spaced at 90 degree intervals about the periphery of a mounting member, each antenna member comprising a generally helical coil mounted on the mounting member, opposed pairs of elongated arms adapted to be alternately disposed downwardly in a non-deployable position and adapted to be disposed at a 45 degree angle to a horizontal plane in a deployable position. The opposed pairs of elongated arms form dipoles which are of differing lengths, such that each opposed pair resonates at a frequency which differs from the other opposed pair. A plurality of baluns, each comprising a broadband coaxial cable, are coiled and wound about the spacers and connected to the dipoles by electrical leads.

Additional objects, advantages and novel features of the invention will be set forth in part in the description which follows, and in part will become apparent to those skilled in the art to which the description pertains. The objects and advantages of the invention may be realized and attained by means of the instrumentalities and combinations particularly pointed out in the appended claims.

BRIEF DESCRIPTION OF THE DRAWINGS

Reference is made to the accompanying drawings in which is shown an illustrative embodiment of the invention, from which its novel features and advantages will be apparent. In the drawings.

DESCRIPTION OF THE PREFERRED EMBODIMENT

Figure 1:
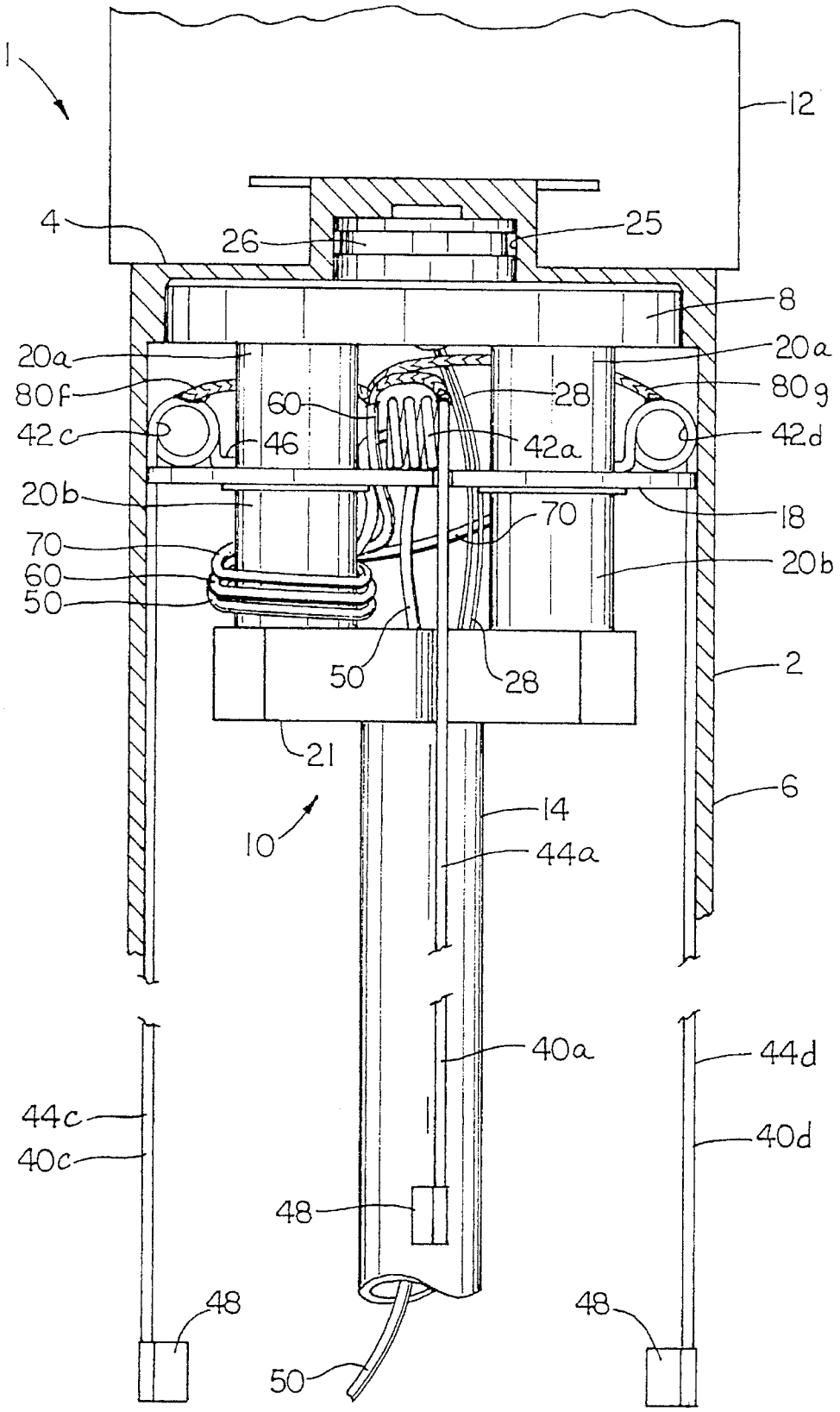
FIG. 1 is a side elevational view, partly in section, of one form of deployable antenna assembly illustrative of an embodiment of the invention.
Figure 2:
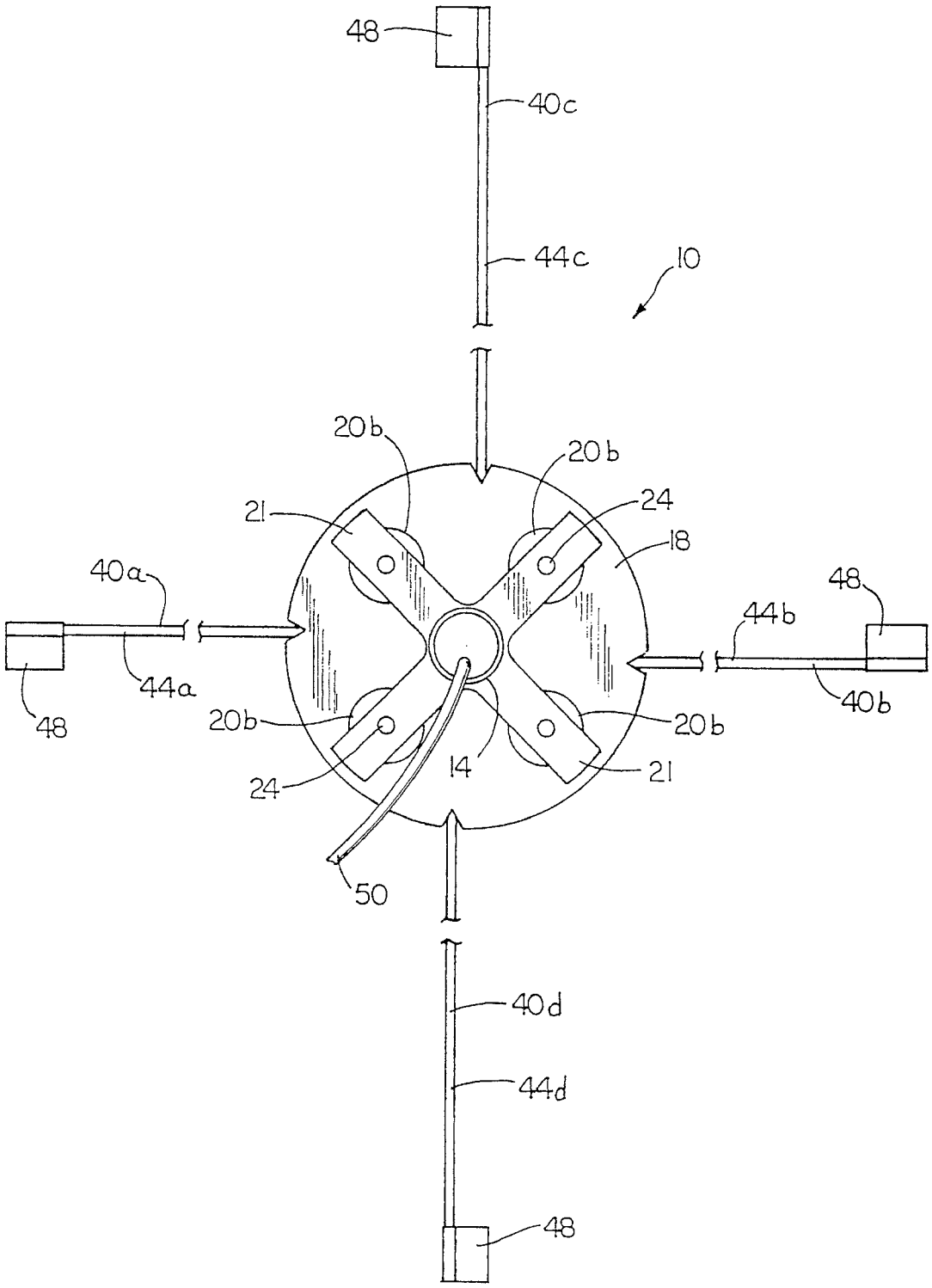
FIG. 2 is a bottom plan view of the antenna assembly of FIG. 1 following deployment.
Figure 6:
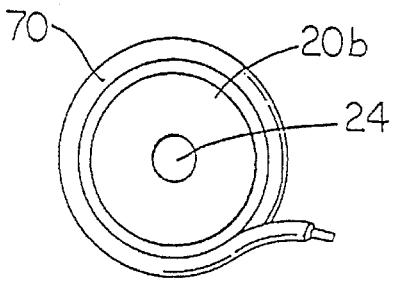
FIG. 6 is a diagrammatic illustration, end-wise, of spacer and cable components of the assembly.

In FIG. 1, there is illustrated a deployable antenna system 1 of the present invention. A tubular canister 2 with closed top end cap 4 houses an antenna assembly 10 when the antenna assembly is not in use. Extending from the tubular canister 2 is a conventional penetrator 12, known in the prior art. The antenna assembly 10 further includes a top plate 8 and a mounting member 18. Extending from the top plate 8 to the mounting member 18 are spacers 20*a* and from the mounting member 18 to a support block 21 are spacer members 20*b*, each spacer member 20*a* being aligned with a spacer member 20*b*, the spacer members 20*a*, 20*b*, preferably are made of Fiberglass and retained by fasteners which may be screws 24 (FIGS. 2, 4 and 6), engaged in the support block 21 (FIGS. 1 and 2). Seated in a coaxial cavity 25 in the end cap 4 is a discharge element 26 (FIG. 1) which is actuable by a signal transmitted thereto through a conductor 28 which extends into an elongated cylindrical mast 14.

Figure 4:
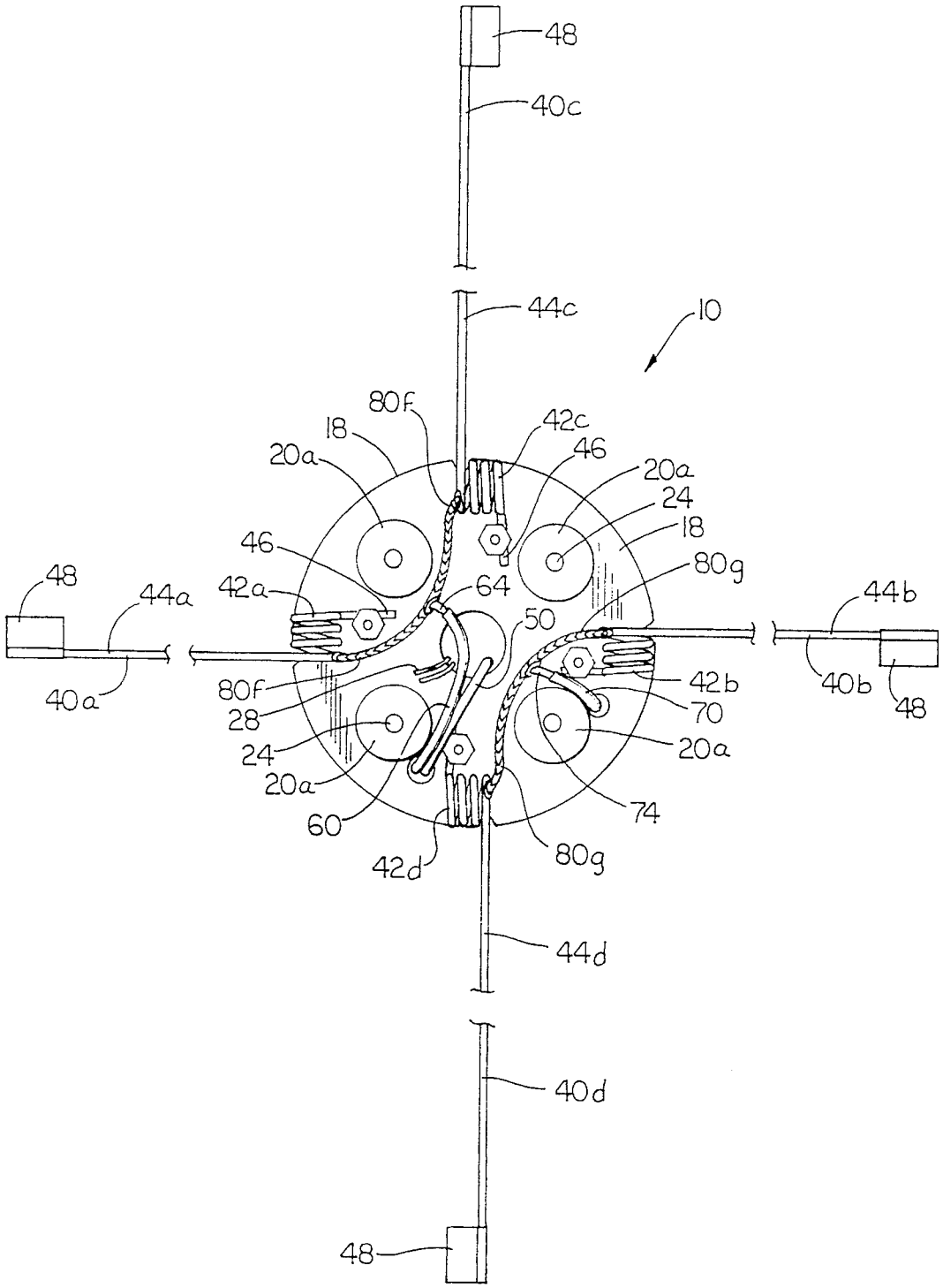
FIG. 4 is top plan view with plate removed to show the assemblage of electrical components in the antenna assembly.
Figure 5:
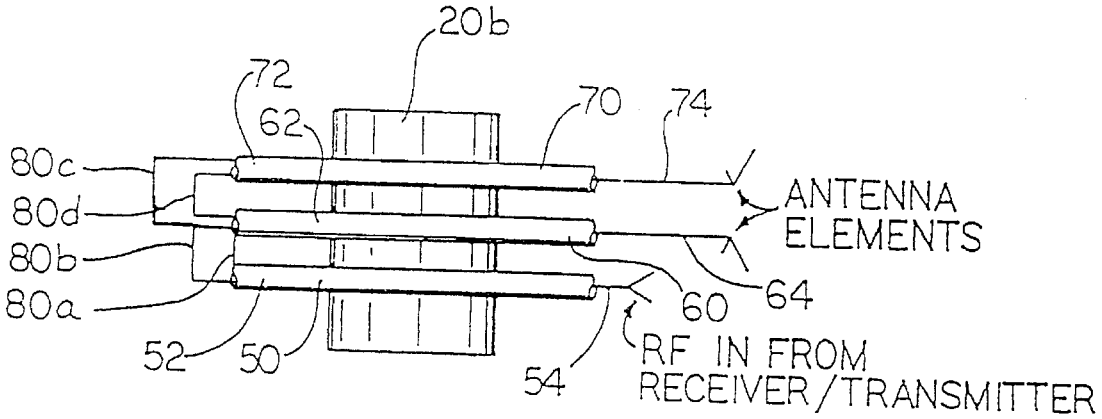
FIG. 5 is a diagrammatic illustration of spacer and cable components of the assembly.

Wound about a spacer 20*b* are broadband coaxial cables 50, 60 and 70 (FIG. 5). The cables 50, 60 and 70 may be coiled so as to conserve space as well as increase the bandwidth. Referring to FIG. 5, it will be seen that from a shield 52 of the coaxial cable 50, extends a lead 80*a* which attaches to a shield 62 of the coaxial cable 60. From a core conductor 54 a lead 80*b* extends to a core conductor 64. From a shield 72 of coaxial cable 70, extends a lead 80*c* which attaches to conductive core 64. From the conductive core 74 of coaxial cable 70 extends a lead 80*d* which attaches to shield 62. Leads 80*f* and 80*g* (FIG. 4) extend from the upper end of each of the cables 60, 70 above the mounting member 18, to contact antenna elements 40*a*, 40*b*, 40*c*, and 40*d*.

Figure 3:
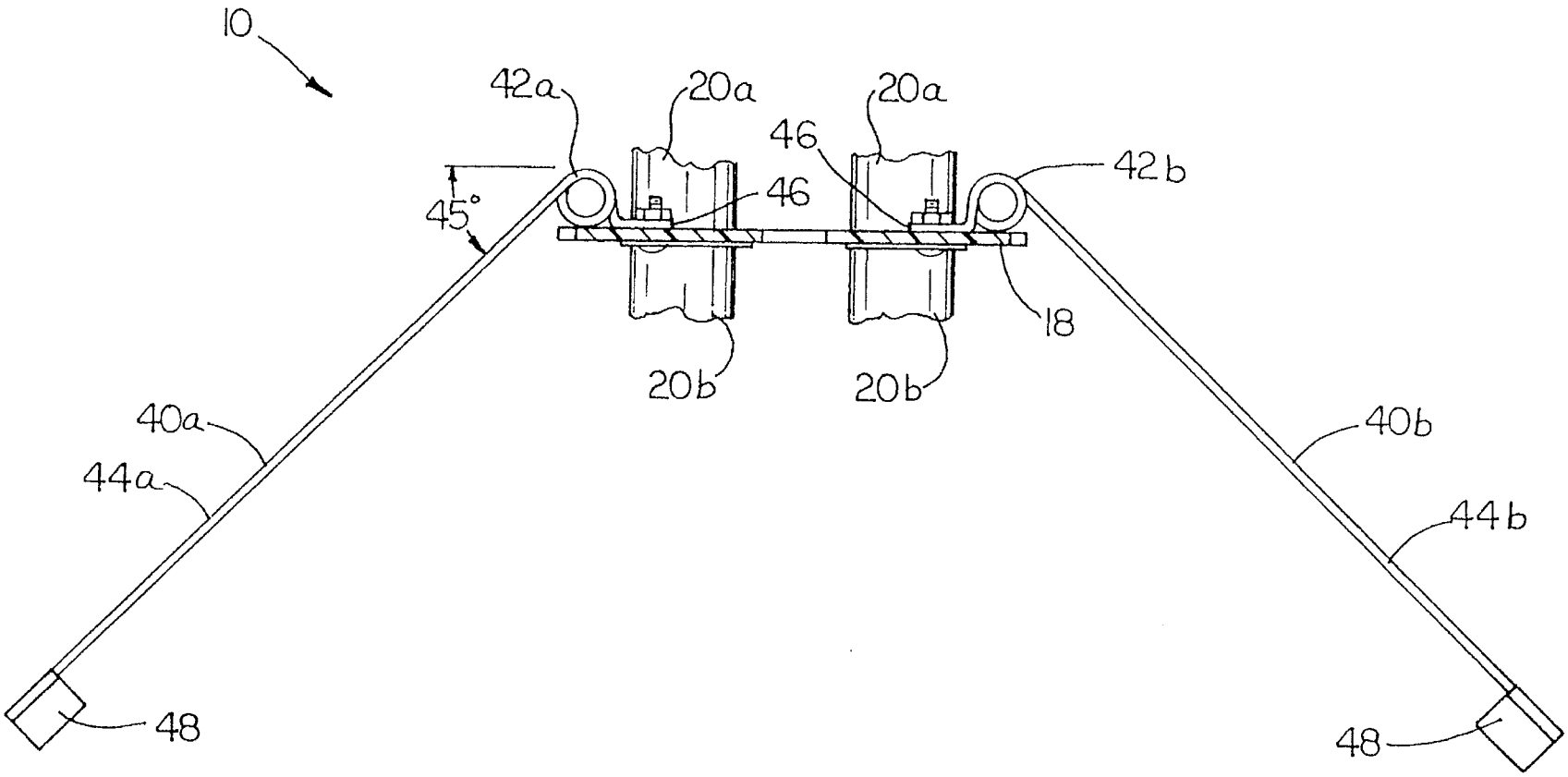
FIG. 3 is a side elevational view of a portion of the antenna assembly of FIG. 1 following deployment.

The four antenna elements 40*a*, 40*b*, 40*c*, 40*d*, shown in FIGS. 2 and 4, are spaced about the periphery of the mounting member 18 (FIGS. 1 and 2–4) at 90° intervals, and each comprises a length of resiliently deflectable wire formed into a helical coil spring 42*a*, 42*b*, 42*c*, 42*d* with a tail 46 extending from one end thereof and bonded to mounting member 18. Extending from the opposite end of each of the coil springs 42*a*, 42*b*, 42*c*, 42*d*, is an elongated arm 44*a*, 44*b*, 44*c*, 44*d*, each having a proximal and distal end.

In FIG. 1, the arms 44*c* and 44*d* are shown deflected downwardly to flex coil springs 42*c* and 42*d*, and resiliently bear against an inner wall of a tubular body 6 of canister 2. The antenna elements 40*a* and 40*b* form a first dipole and the antenna elements 40*c* and 40*d* form a second dipole.

The arms of one of the two dipoles differ in length from the arms of the other dipole. This construction facilitates the operation of the antenna at two different frequencies. The antenna arms 44*a*, 44*b* the first dipole have a length which is shorter than the antenna arms 44*c*, 44*d*, of the second dipole, such that the longer length dipole preferably operates at 250 mHz and the shorter length dipole preferably operates at 350 mHz. Copper tape flags 48 are utilized on each of the arms 44*a*, 44*b*, 44*c*, 44*d*, to reduce the length of the arms and increase the signal bandwidth at each frequency. A portion of the helical springs 42*c* and 42*d* are utilized as tuning devices, further reducing the length of the longer arms 44*c* and 44*d*.

Shown in FIG. 3 is a side elevational view of a portion of the antenna assembly 10 following deployment. Each of the arms 44*a*, 44*b*, 44*c*, 44*d* (arms 44*a* and 44*b* shown in FIG. 3) extend outwardly at a 45° angle to the horizontal. Such a configuration enables the directivity pattern of the radiation beam to be significantly broader than the directivity pattern when the arms extend outwardly and lie on the horizontal. Moreover, the use of a 45° angle permits the radiation to be omnidirectional.

FIG. 4 illustrates the configuration of electrical leads extending from the coaxial cables 60, 70 to the antenna assembly 10. Coaxial cable 50 extends to a transmitter (not shown). Extending from an end of conductive core 64 of coaxial cable 60 is the lead 80*f* which extends to the coil spring 42*a* of antenna element 40*a*. Similarly, extending from the core conductor 64 of coaxial cable 60,the lead 80f extends to coil spring 42*c* of antenna element 40*c*. Extending from the conductive core 74 of coaxial cable 70, is the lead 80*g* which extends to coil spring 42*b* of antenna element 40*b*. Similarly, extending from the core conductor 74 of coaxial cable 70, lead 80*g* extends to coil spring 42*d* of antenna element 40*d*. All lead connections may be potted in a synthetic resin to provide a watertight seal.

Thus, both dipoles are fed in parallel. The radiation is omnidirectional in azimuth and elevation, as well as being linearly polarized, thereby ensuring compatibility with circularly polarized sources and receivers.

The operation of the antenna system is now described. Upon actuation of discharge element 26, as a result of a signal transmitted through the conductor 28, the penetrator 12 and canister 2 are pushed upwardly and free from engagement with the antenna assembly 10. The antenna arms 44*a*, 44*b*, 44*c*, 44*d*, respectively, spring outwardly (FIG. 3) into a position wherein each arm is disposed at 45° angle to the horizontal, as a result of the torsion in the coil springs 42*a*, 42*b*, 42*c*, 42*d*, respectively. At this point, the dipoles have the capability to transmit and receive at two different frequencies concurrently.

Although the invention has been described with respect to a preferred embodiment, it will be appreciated that various rearrangements and alterations of parts may be made without departing from the spirit and scope of the invention as defined in the appended claims.

What is claimed is:

1. A dual frequency lightweight deployable antenna system comprising:

a tubular canister having a closed end and an open end;

a plate member disposed in said canister proximate said canister closed end;

a mounting member disposed in said canister removed from said plate member in a direction toward said open end;

a support block disposed in said canister removed from said mounting member in a direction toward said open end;

spacer elements disposed between said plate member and said mounting member and between said mounting member and said support block;

an elongated hollow mast extending from said support block in a direction away from said canister closed end, said canister being movable relative to said mounting member between a first and a second position;

four antenna elements of resiliently deflectable wire and spaced at 90° intervals about the periphery of said mounting member, each of said antenna elements comprising a coil spring mounted on said mounting member, an elongated arm, and a conductive flag fixed to a distal end of said arm, said arms being adapted to be constrained by said canister in a position parallel to each other and normal to said mounting member when said canister is in said first position, and adapted to be disposed at a 45° angle to said plate member when released by removal of said canister from said arms by movement of said canister to said second position;

a first pair of said arms comprising a first dipole;

a second pair of said arms comprising a second dipole, said first dipole resonating at a frequency different from the frequency at which the second dipole resonates; and cable means for interconnecting said antenna elements with a receiver/transmitter.

2. The dual frequency lightweight deployable antenna system of claim 1 wherein said first pair of arms includes elongate arms of lengths different from the lengths of the arms of the said second pair of arms.

3. The dual frequency lightweight deployable antenna system of claim 1 wherein the frequency at which said first and second dipole pairs resonate is 250 mHz and 350 mHz, respectively.

4. The dual frequency lightweight deployable antenna system of claim 1 wherein said conductive flags fixed to said arms comprise copper tape flags.

5. The dual frequency lightweight deployable antenna system of claim 4 wherein said copper tape flags are disposed on the distal ends of each of said elongate arms, thereby providing shortened element lengths and increased signal bandwidth.

6. The dual frequency lightweight deployable antenna system of claim 1 wherein said coil springs associated with said first dipole are utilized as tuning devices, thereby providing further shortening of said first dipole arms.

7. The dual frequency lightweight deployable antenna system of claim 1 wherein said cable means comprises three broadband coaxial cables, each of said cables comprising a conductive core and a conductive shield.

8. The dual frequency lightweight deployable antenna system of claim 7 wherein said cable means comprises leads which connect the respective shields of said broadband coaxial cables to the cores of other of said broadband coaxial cables.

9. The dual frequency lightweight deployable antenna system of claim 7 wherein said cable means further comprises leads which connect the respective cores of two of said cables each to two of said coils springs.

10. The dual frequency lightweight deployable antenna system of claim 7 wherein said broadband coaxial cables are wound in a coiled configuration, thereby providing increased signal bandwidth.

* * * * *